US006453818B1

(12) United States Patent
Brent

(10) Patent No.: US 6,453,818 B1
(45) Date of Patent: Sep. 24, 2002

(54) METHOD OF CONTROLLED BLASTING

(75) Inventor: Geoffrey F. Brent, New South Whales (AU)

(73) Assignee: Orica Explosives Technology Pty Ltd., Melbourne (AU)

( * ) Notice: Subject to any disclaimer, the term of this patent is extended or adjusted under 35 U.S.C. 154(b) by 0 days.

(21) Appl. No.: 09/284,913

(22) PCT Filed: Oct. 13, 1997

(86) PCT No.: PCT/AU97/00679

§ 371 (c)(1),
(2), (4) Date: Jul. 20, 1997

(87) PCT Pub. No.: WO98/17964

PCT Pub. Date: Apr. 30, 1998

(30) Foreign Application Priority Data

Oct. 18, 1996 (AU) ..... 3071/96

(51) Int. Cl.[7] ..... F42B 1/00; F42B 5/38

(52) U.S. Cl. ..... 102/313; 102/312; 102/315; 102/323; 102/324

(58) Field of Search ..... 102/315, 323, 102/324, 312, 313

(56) References Cited

U.S. PATENT DOCUMENTS

| | | | | | |
|---|---|---|---|---|---|
| 1,298,500 | A | * | 3/1919 | Hardel | 102/315 |
| 2,929,325 | A | * | 3/1960 | Lewis | 102/315 |
| 2,966,855 | A | * | 1/1961 | Barco | 102/323 |
| 3,462,324 | A | * | 8/1969 | Grant et al. | 102/315 |
| 3,580,171 | A | * | 5/1971 | Maes | 102/315 |
| 3,731,625 | A | * | 5/1973 | Slawinski | 102/324 |
| 4,036,099 | A | | 7/1977 | French | 86/20 C |
| 4,492,165 | A | * | 1/1985 | Marz | 102/324 |
| 4,787,316 | A | * | 11/1988 | Drury et al. | 102/324 X |
| 5,092,245 | A | * | 3/1992 | Douglas et al. | 102/324 |
| 5,273,110 | A | * | 12/1993 | Fitzgibbon, Jr. | 85/20.15 |
| 5,584,222 | A | * | 12/1996 | Engsbraten et al. | 102/313 X |
| 5,874,688 | A | * | 2/1999 | Lubbe et al. | 102/313 X |

FOREIGN PATENT DOCUMENTS

| | | |
|---|---|---|
| AU | 57045/90 | 12/1990 |
| AU | 41210/93 | 12/1993 |
| AU | 55285/94 | 9/1994 |
| GB | 2187490 | 9/1987 |

OTHER PUBLICATIONS

Derwent Abstract, Streich, #DE 3246157.
Derwent Abstract, Andre, et al., #FR 2714457.
Derwent Abstract, Andre, et al. #GB 2292446.
Derwent Abstract, Shann, #GB 2160857.
Derwent Abstract, Shnaider, et al., #RU 2017956.
Derwent Abstract, Zyryanov, #RU 2017956.
Derwent Abstract, Golovanov, et al., #SU 1834667.
Derwent Abstract, Kingery, et al., #US 5303653.
Derwent Abstract, Kulakov, et al., #SU 1770923.
Derwent Abstract, Knystautas, et al., #CA 2021396.
Derwent Abstract, Knystautas, et al., #US 5168123.

* cited by examiner

*Primary Examiner*—Peter A. Nelson
(74) *Attorney, Agent, or Firm*—Pillsbury Winthrop LLP

(57) ABSTRACT

The invention of the present application provides a method of controlled blasting comprising dispersing an explosive (9) within a blasthole (1) to form a dispersed explosive having a lower average bulk density than said explosive (9) prior to dispersion and detonating said dispersed explosive. Typically the explosive (9) is dispersed in air, however the explosive (9) may be dispersed in other matrices such as other gases or liquids or in gases comprising particulate matter. The explosive (9) may be dispersed using a number of different techniques such as, using a discharge of pressurised fluid or by detonation of a small propellant charge or by falling under gravity in the blasthole. The invention of the present application is particularly useful where a reduced concentration of explosive energy is required such as in perimeter control, presplitting or soft rock conditions, can be controlled by a method which involves dispersion the explosives composition (9) within a blasthole prior to initiating the blast. The dispersion of the explosive composition (9) within a blasthole (1) provides an in situ low density explosives composition.

22 Claims, 4 Drawing Sheets

METHOD OF CONTROLLED BLASTING

Figure 1:
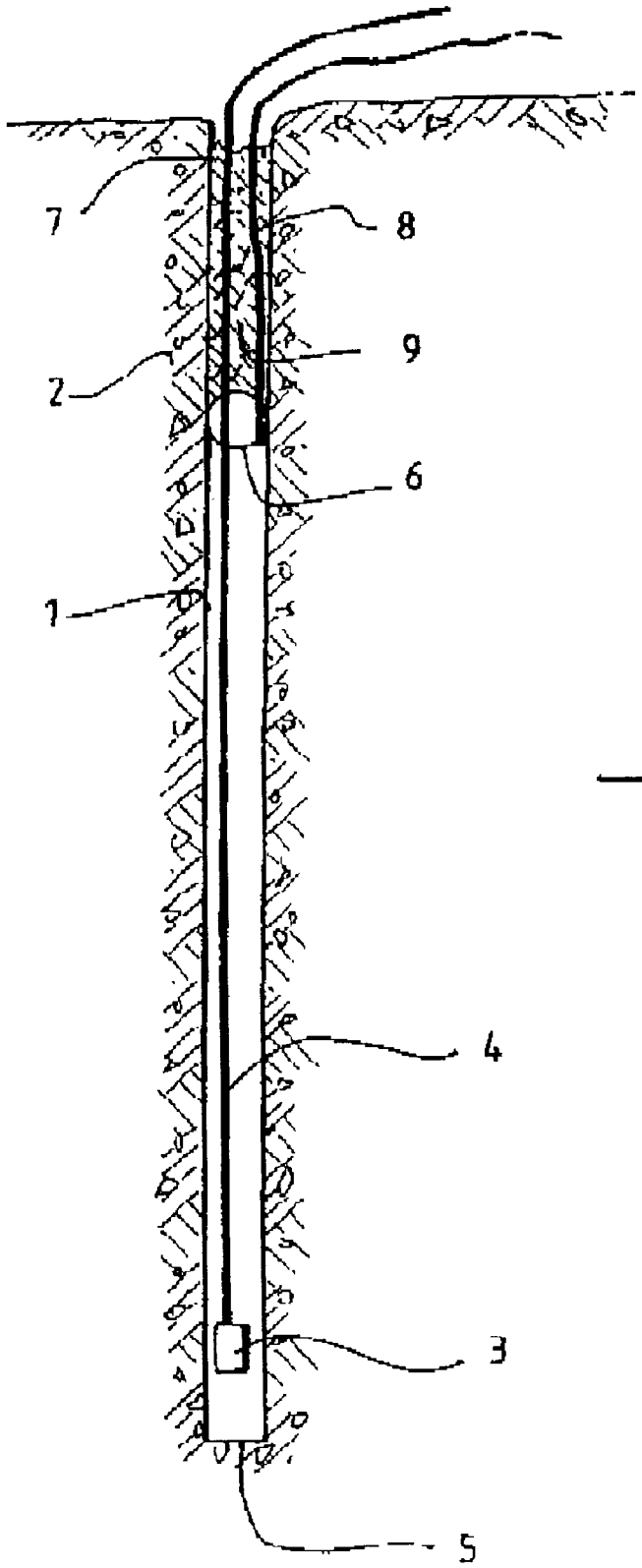

The current invention relates to a method or blasting. In particular the current invention relates to a method of controlled blasting using dispersed explosive. More particularly the current invention relates to a method of controlled blasting comprising dispersing an explosive and then detonating the dispersed explosive.

Although the current invention will be described with reference to perimeter blasting, or presplitting, it is to be noted that the scope of the present invention is not limited to the described embodiment but rather the scope of the invention is more extensive so as to include the use of the current invention for blasting applications other than perimeter blasting or presplitting.

The objective of commercial blasting operations is to break rock and/or shift material in a useful way and explosive charges are positioned and detonated to maximise the desired effect. When an explosive charge explodes a powerful force is exerted in all directions but most movement will occur along the line of least resistance or least confinement.

In most mining applications it is desirable to locate explosives in such a way that the explosive force will break to a free face without too much confinement. In above ground mines the principal free face is called a "highwall" and may be dozens of meters in height.

Generally the most economical method of blasting involves detonating explosives located in a large mass of rock (called a "blast block") such that the rock broken by the explosives is thrown into a conveniently located pile for easy loading into trucks. Blast blocks are kept as large as practicable to maintain economy of scale and minimise time lost in vacating and then re-entering the blast area.

Blasting results are influenced to a large extent by the shape and size of the blast block and the distribution and type of explosives within this volume. The location of blastholes, their depth, diameter, angle and quantity of explosive in each hole are parameters critical to the success or failure of a blast and can greatly influence the overall cost of mining.

Fragmentation and productivity are also generally improved by using staggered blasthole patterns rather than square or rectangular patterns. The sequence in which the blastholes are detonated is also important as the result of any multiple-hole blast depends on interactions between adjacent blastholes. The results of a well designed multi-hole blast are far superior to firing the same number of blastholes individually or at random.

In mining operations poorly designed blasts frequently cause overbreak and damage beyond the intended blast block volume. Overbreak and damage are frequently minimised using one or more of a number of techniques including:

(i) reducing the amount of burden rock which is pushed forward by each explosive charge and promoting progressive relief or burden during the blast;

(ii) reducing concentration of explosives energy within each blast hole; and (iii) presplitting.

Presplitting is a method of creating more stable free faces or highwalls which are steeper and smoother than those which can be achieved by firing normal production blasts. Presplitting is generally carried out ahead of the production blast and can be utilised to improve control of blasts, by producing a constant burden for front-row blastholes. Presplitting involves drilling a row of closely-spaced parallel blastholes along the line of the proposed "new" free face or highwall and then very lightly charging these blastholes and detonating them simultaneously or in large groups. The objective of presplitting is to attain a pressure sufficient only to form a crack between the presplit blastholes while not causing excessive damage to the surrounding rock. Firing of the presplitting charges produces an intra-row crack along the proposed "new" free face or highwall and the subsequent production blast can break along this fracture.

A crank formed by firing of presplitting charges acts as a pressure-release vent for the explosive gases generated in front of the crack. The presence of a crack also causes partial reflection of blast-generated stress waves, and thus reduces the intensity of the strain wave experienced behind the presplit. As a result of this, the disruption and shatter of the subsequently exposed free face are much reduced.

In practice, the diameter of blastholes for explosive presplitting is usually the same as that of production blastholes. In the current practice of presplitting using large diameter blastholes, the blastholes for presplitting are often deck loaded. Deck loading or charging is the practice of separating or isolating short columns of explosives called "decks" within a single blasthole. The decks may be isolated from one another using drill cuttings, gravel, air or other inert material. Each explosives deck generally contains at least one primer and may consist of either a bulk explosives or packaged explosives. The decks are also usually "coupled", that is the charge extends across the entire diameter of the borehole and is confined by the borehole walls.

One of the problems of this type of loading is that it may lead to uneven distribution of explosive and concomitantly uneven distribution of detonation energy. In general, excessive energy is released in the region of the deck charge and the highwall tends to be unevenly split. An unevenly thrown face burden requires more labour to collect compared to an evenly thrown burden. Furthermore, an uneven highwall face tends to be unstable and thus constitutes a safety hazard.

The use of decks of explosives in blastholes also has the disadvantage of being relatively time consuming to load and requires the use of a separate primer for each charge of explosive in the borehole. The longer the loading time for each blasthole, the fewer the blastholes which can be loaded per day and the higher the labour costs.

Currently, in underground mining operations, perimeter control blasting is often achieved by loading the perimeter blastholes with low density explosives. Low density explosives, particularly those with a density below 0.6 $g/cm^3$, are expensive and often difficult to manufacture. Low density explosives also suffer from the drawback of being unsuitable for use in wet blastholes.

In order to overcome the aforementioned difficulties, attempts have been made to reduce explosive power by partially loading blastholes with explosives. However, partial filling involves difficult and time consuming loading procedures and often leads to explosives wastage. Presplitting and perimeter control may also be achieved by using decoupled charges to reduce the overall density of the explosives in the blasthole. For example, packaged explosives are used in small diameter blastholes for presplitting. However, these explosives are costly and decoupling may lead to misfires due to the well known phenomenon called "channel effect". Furthermore, the handling problems associated with decoupled charges normally restrict their use to small diameter applications.

It has now been found that blasting, particularly where a reduced concentration of explosive energy is required such as in perimeter control, presplitting or soft rock conditions, can be controlled by a method which involves dispersing the explosives composition within a blasthole prior to initiating the blast. The dispersion of the explosive composition within a blasthole provides an in situ low density explosives composition. The in situ provision of low density explosives overcomes many of the problems associated in the past with the cost of loading low density explosives and the effects of uneven distribution of explosives detonation energy. The provision of in situ low density explosives also overcomes the need to provide decoupled explosives charges.

Accordingly, the present invention provides a method of loading an explosive within a blasthole wherein said explosive is supported by a retaining means, disrupting or removing said retaining means and dispersing said explosive within the blasthole to form a dispersed explosive having a lower average bulk density than said explosive prior to dispersion and detonating said dispersed explosive.

Where used herein the term dispersion refers to scattering or disseminating explosive. Typically the explosive is dispersed in air, however the explosive may be dispersed in other matrices such as other gases or liquids or in gases comprising particulate matter. The liquid may be in any form such as a mist or vapour. For example the explosive may be dispersed within the air in a blasthole. The air within the blasthole may be enriched with oxygen or other gases or may contain particulate matter such as coal dust. A liquid such as nitroglycerine or petroleum ether or the like may be present as a mist or vapour in the air of the blasthole.

The explosive for use in the present invention may comprise a single chemical species or mixture of chemical species in any convenient form. For example the explosive may be in the form of a solid or liquid or mixtures thereof, including finely divided solids such as powders, or emulsions, colloids, suspensions and the like. For example, the explosive composition may comprise fuels such as aluminium powder, carbonateous powders or liquid carbonaceous fuels which require chemical reaction with the oxygen in the blasthole. Alternatively, the explosive may comprise a mixture of fuels and oxidisers such as aluminium or carbonaceous powders mixed with oxidisers such as ammonium nitrate and the like, or may comprise ammonium nitrate plus fuel oil (ANFO) explosives, ANFO based explosives, emulsion explosives or mixtures thereof. The explosives may further comprise a self-oxidising composition such as molecular high explosives such as pentaerythritoltetranitrate (PETN), trinitrotoluene (TNT), nitroglycerine (NG), cyclotetramethylene tetranitramine (HMX), cyclo-1,3,5-trimethylene-2,4,6 trinitramine (RDX), explosives based on such molecular high explosives or mixtures thereof.

The method of the present invention may be used in upholes, that is blastholes drilled vertically upwards or at an upwardly inclined angle, and in downholes, that is blastholes drilled vertically downwards or at a downwardly inclined angle.

In the method of the present invention, the explosive may be dispersed using a number of different techniques. For example, the explosive may be dispersed using a discharge of pressurised fluid such as air or water. For example, a pressurised container holding the dispersing fluid may be initially loaded into the hole with the explosive and subsequently rapidly vented to disperse the explosive throughout the hole prior to initiating the explosive.

Alternatively, the explosives may be dispersed by detonation of a propellant charge of sufficient strength to disperse the explosives charge without initiating the explosives charge. The explosive may additionally be dispersed by falling under gravity in the blasthole.

In the method of the present invention the dispersed explosive is detonated to provide the controlled blast. In practice the initiation or detonation may be timed to occur while all or only part of the explosive is in the process of being dispersed, that is, while all or only part of the explosive is in motion in the blasthole. Alternatively, the initiation of detonation may be timed to occur after the explosives composition has been dispersed and is no longer in motion in the blasthole. The timing of the initiation of the explosive may be achieved using any conventional time delay initiator, such as non-electric delay detonators, electric delay detonators or electronic delay detonators.

The method of blasting of the present invention whereby detonation of the explosive is initiated while the explosive is still in motion in the blasthole is suitable for use in upholes and downholes and is particularly suitable for use in downholes.

The explosive may be dispersed in the blasthole using any convenient means. For example, the explosive may be dispersed using a discharge of pressurised liquid and/or gas or by detonating a propellant charge of sufficient strength to disperse the explosive without initiating the explosive.

In downholes, the explosives charge may also be dispersed during or after falling under gravity. For example, dispersion of the explosives charge may be achieved by loading the desired explosives composition on a temporary retaining means at or near the collar of the blasthole and then removing that temporary retaining means. The explosive is thus allowed to fall under gravity and be dispersed.

Suitable retaining means include inflatable bags of the type commonly used in blasting operations, membranes, suitably designed blasthole plugs, such as a plug of grouting material or polystyrene foam and the like. The retaining means may be designed to control or modify the rate and pattern of fall of the explosive as required.

The retaining means may be removed by any suitable means known in the art such as the use of a small charge such as a detonator, detonating cord, non-electric initiation tubing, primer charge or propellant charge or by the use of pressurised fluid. Where a small charge is used to remove the retaining means, the small charge may also contribute to adequate dispersion of the explosives charge without initiation of the explosives charge.

In the method of blasting of the present invention the explosives composition is detonated by any convenient means and/or devices known to those skilled in the art. For example, initiation may be carried out using electric or non-electric detonators, signal tube, detonating cord, primers or suitable combinations thereof. Typically the explosives composition is detonated by initiation of a primer (also called a booster) and a detonator, the primer being located at any suitable position in the blasthole. For example, the detonator and primer may be located at a point approximately between the midpoint of the blasthole and the toe of the blasthole and preferably around midpoint of the blasthole. Alternatively, if toe priming is desirable, the primer is located at the toe of the blasthole. In downholes this may be an advantage as the time of initiation of the primer may be chosen such that the primer is surrounded by a substantial amount of explosive which has reached the toe after falling down the blasthole.

The explosives charge may be detonated at a suitable time during or after dispersion. Where the explosive composition is allowed to fall under gravity after disruption or removal of a retaining means, the initiation may occur at a suitable time interval after disruption or removal of the retaining means. Preferably the interval is of a sufficient length as to allow all of the explosives charge to become dispersed.

Preferably the explosives charge is detonated such that the majority of the explosives charge is still in motion in the blasthole when the detonation occurs. More preferably the explosives is detonated at a time when the explosive is well distributed throughout the hole. More preferably the explosives charge is detonated at a time when some of the explosive has at least reached the mid-point of the blasthole before detonation. More preferably the explosive is detonated at a time when the explosive first contacts the toe of the hole, and there is distribution of explosive throughout the length and width of the hole. It is also preferable that at the time of detonation the explosive is uniformly distributed along the length of the blasthole such that the bulk density is constant along the length of the blasthole. However, this is not essential and the distribution of explosive need not be uniform along the length of the blasthole.

Preferably the initial average bulk density of the explosive used in the current invention before dispersion is between 0.5 and 1.5 g/cm$^3$. Preferably after the dispersion, or more preferably at the time of detonation, the average bulk density of the dispersed explosive is between 1.2 g/cm$^3$ and 0.001 g/cm$^3$.

The precise timing of the detonation may depend on a variety of factors such as the physical characteristics of the explosives charge, the bulk density and distribution of explosive desired. The precise timing may also depend on the characteristics of the blasthole such as the length and inclination, of the blasthole.

Where the explosive composition is retained at the collar of the blasthole and then allowed to fall under gravity, the technique used to remove or disrupt the retaining means and allow the explosive to fall may also be used to disperse or assist in the dispersion of the explosive. For example, where the retaining means is disrupted or removed using a small charge, the detonation of the small charge may directly cause or assist in the dispersion of the explosive.

The method of blasting of the present invention whereby detonation of the explosive is initiated after the explosive has been dispersed and is substantially static in the blasthole, is particularly suitable for use in blastholes which are substantially horizontal or inclined at an angle of up to 45 degrees from the horizontal. Dispersion may be achieved by loading the desired explosives composition which may be on a retaining means at any convenient position along the blasthole and then removing the retaining means and dispersing the explosives charge using a discharge of pressurised fluid or by detonating a propellant charge of sufficient strength to disperse the explosive without initiating the explosive.

The present invention also provides a method of controlled blasting comprising the steps of:

locating a time delay initiation device in a blasthole, loading an explosives composition into said blasthole, dispersing the explosives composition within the blasthole using gravity or by a dispersing charge or by discharge of pressurised fluid, and initiating the dispersed explosives composition during or alternatively after dispersion by firing the time delay initiation device.

The present invention further provides a method of controlled blasting comprising the steps of:

locating a time delay initiation device in a blasthole, using a retaining means to support an explosives composition near the top of said blasthole, disrupting or removing said retaining means, then dispersing the explosives composition within said blasthole, and initiating the dispersed explosives composition during or alternatively after dispersion by firing the time delay initiation device.

The present invention further provides a method of controlled blasting comprising the steps of;

locating a time delay initiation device in a blasthole, using a retaining means to support an explosives composition at or near the top of said blasthole, locating a second retaining means nearer to the collar of the blasthole, loading stemming material onto the second retaining means—disrupting or removing the first retaining means, then dispersing the explosives composition within the blasthole, and initiating the dispersed explosives composition during or alternatively after dispersion by firing the time delay initiation device.

EXAMPLES

The invention is further described with reference to the following non-limiting examples;

Example 1

Figure 2A:
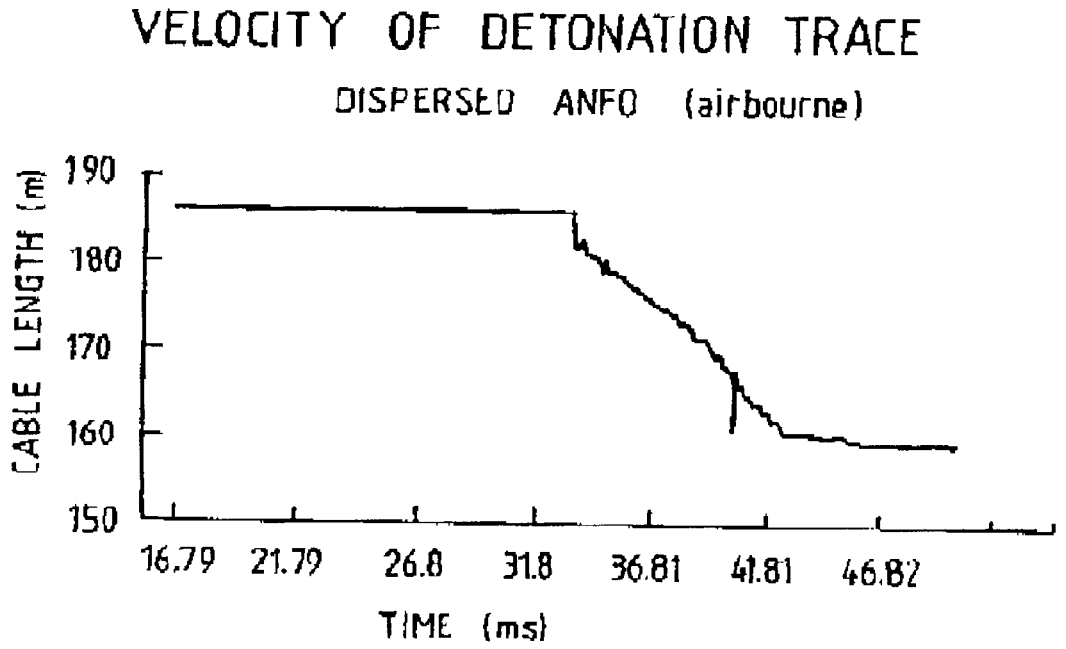
Figure 2B:
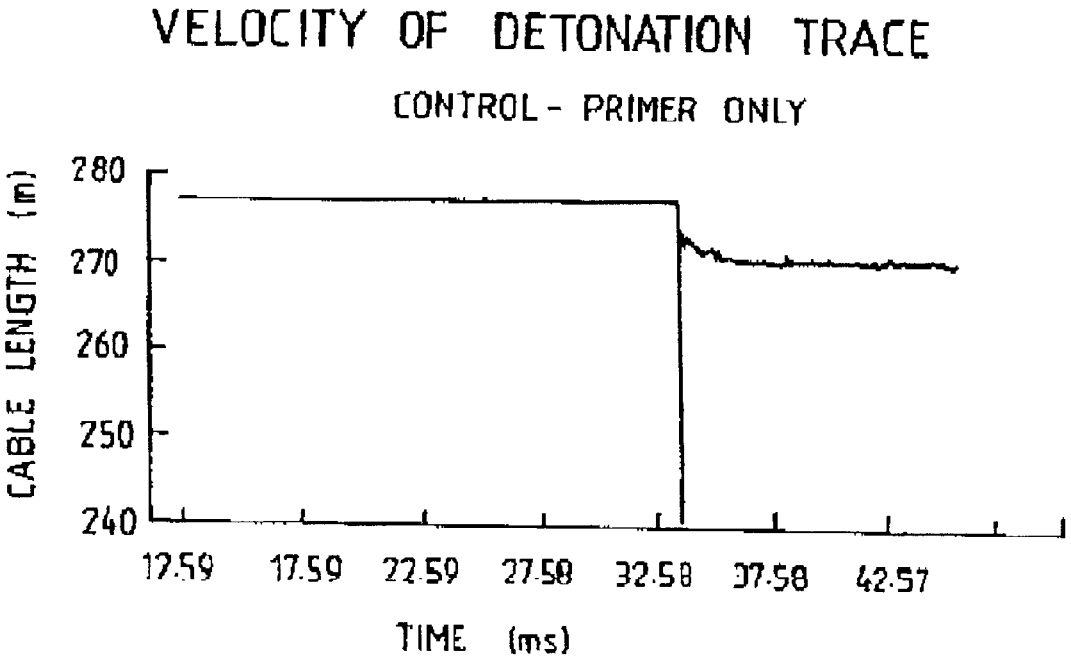

A 22 meter deep vertical downhole of diameter 254 mm was primed with a non-electric DELAY detonator and a booster suspended 1 meter from the toe of the downhole. An airbag of the type widely used in blasting was lowered to about 3 meters from the collar of the downhole and was inflated such that it was wedged into position within the downhole. The inflated airbag formed the removable supporting structure. A length of low energy detonating cord (3.6 grams/meter coreload of pentaerythritol tetranitrate (PETN)) was attached to the airbag. A charge of 110 kilograms of conventional ANFO was poured onto the airbag. Initiation of the detonating cord ruptured the airbag and caused the ANFO to fall down the hole. After a delay of several seconds, the primer was initiated, in turn initiating the ANFO while the entire charge of ANFO was still airborne and dispersed in the downhole. The average bulk density of the ANFO prior to removal of the supporting structure was 0.82 g/cm$^3$ as compared with a bulk density of dispersed ANFO at the time of detonation of 0.099 g/cm$^3$. Measurement of the velocity of detonation of the ANFO using a time-domain reflectometry method showed a steady detonation velocity up the length of the blasthole and an average detonation velocity of 2300 meters/second (which corresponds well with theoretical predictions for ANFO at a density of 0.099 g/cm$^3$). By comparison, a control downhole charged only with a primer in the same manner showed a rapidly decaying VOD trace which stopped about 2 meters from the primer. These traces are shown in FIG. 2. FIG. 2(*a*) is a graph of measuring cable length against time to give a VOD trace for the dispersed ANFO. FIG. 2(*b*) is a graph of cable length against time for the control blasthole.

A drawing of the downhole loading setup used in Example 1 prior to removal of the airbag and dispersion of the explosive is shown in FIG. 1. The drawing shows the vertical downhole 1 drilled in rock 2. The non-electric delay detonator and booster 3 are suspended by non-electric initiation tubing 4 near the toe 5 of the downhole. The inflated airbag 6 is wedged near the collar 7 of the downhole, the inflated airbag attached to a length of low energy detonating cord 8. The charge of ANFO 9 is located on the inflated airbag. The non-electric initiation tubing 4 and low energy detonating cord 8 are attached to an initiating device located remotely from the downhole so that an operator may safely initiate the initiation tubing and low energy detonating cord.

Example 2

Figure 3:
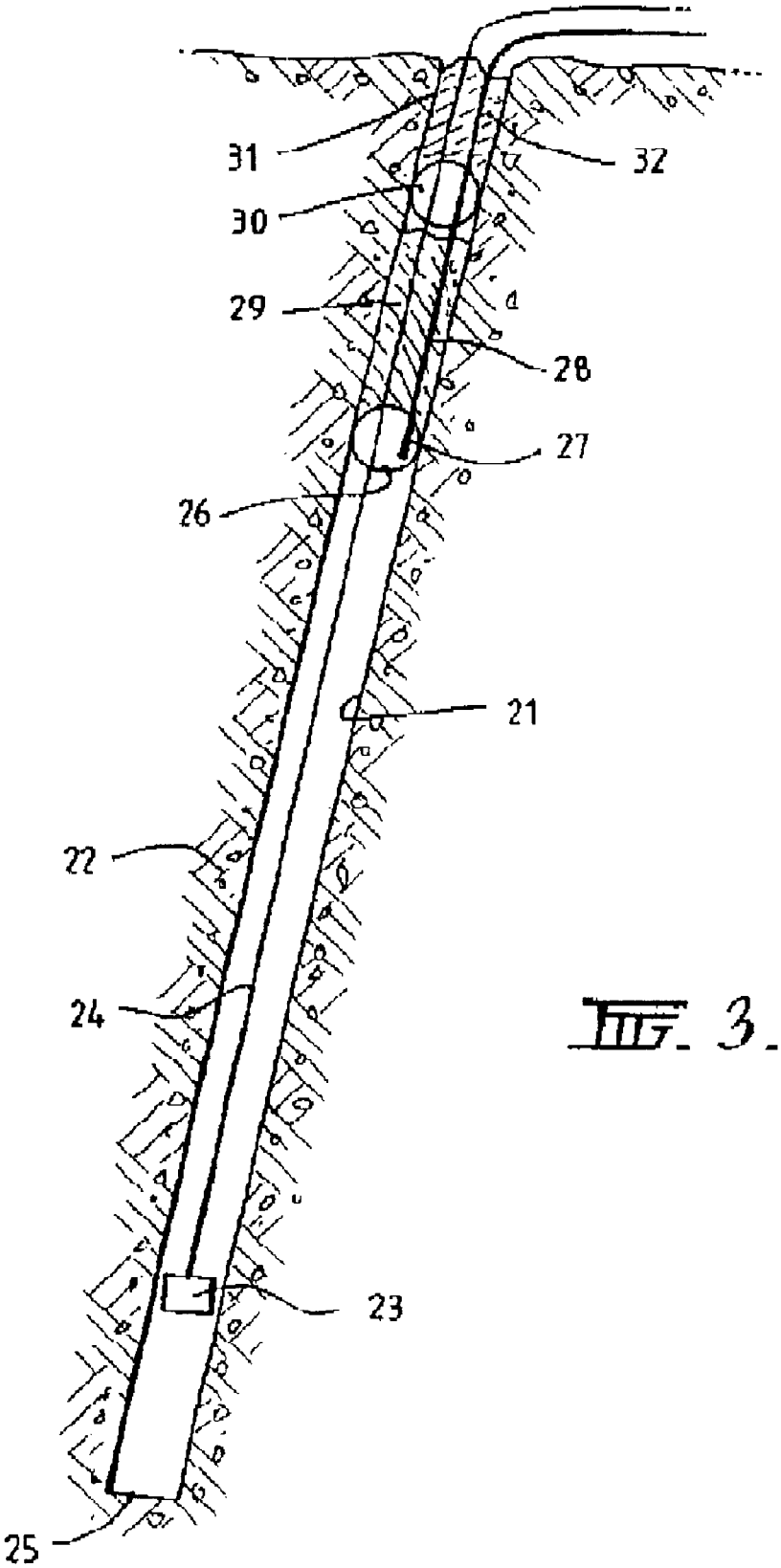

A diagram of the loading setup used in Example 2 prior to dispersion of the explosive is shown in FIG. 3. The diagram shows the inclined downhole 21 drilled in rock 22, the non-electric delay detonator and primer 23 are suspended by non-electric initiation tubing 24 near the toe 25 of the downhole. The first inflated airbag 26 is wedged in the blasthole adjacent a detonator 27 attached to non-electric initiation tubing 28. ANFO 29 is located on the first inflated airbag and detonator. A second inflated airbag 30 is wedged in the downhole near the collar 31 of the blasthole. Stemming material 32 is located on top of the second airbag. The two lengths of non-electric initiation tubing are attached at the surface to a surface initiation system such as detonating cord or non-electric detonators (not shown). In multiple hole controlled blasting such as presplitting, this surface initiation system would be used to initiate all the downhole non-electric tubes. The surface initiation system is remotely fired such that an operator may safely initiate the blast.

A 44 meter deep downhole inclined at 15 degrees to the vertical was primed with a non-electric detonator and a booster suspended at 15 meters from the toe of the blasthole. A first inflated airbag was located 6 meters from the downhole collar. A detonator was lowered into place on the first airbag before 160 kilograms of ANFO was poured onto the first airbag and detonator. A second airbag was inflated and locked into position just above the ANFO. Stemming material (rock aggregate) was placed on top of the second airbag. The detonator on the first airbag was detonated, thus rupturing the airbag and allowing the ANFO to fall down the blasthole. The second airbag supporting the stemming material was undamaged, allowing the stemming material to remain in place at the collar of the blasthole. After a suitable time delay or several seconds the down-hole detonator and primer fired, thus detonating the dispersed ANFO in the downhole. The dispersed ANFO had an average bulk density of 0.072 g/cm$^3$.

A velocity of detonation (VOD) trace using a time-domain reflectometry method was obtained and showed successful detonation of the dispersed ANFO.

Example 3

Figure 4A:
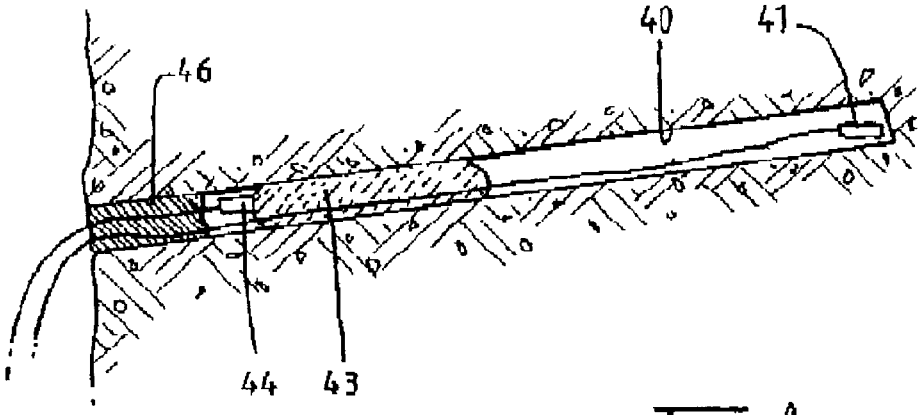
Figure 4B:
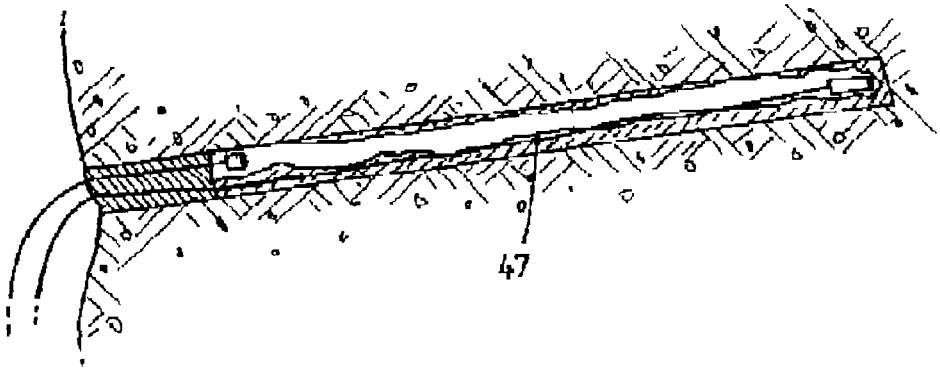

The attached FIG. 4 shows the setup as demonstrated by this example both before dispersion of the explosive and after dispersion of the explosive just prior to initiation of the explosive. FIG. 4(*a*) shows a 45 mm diameter, nearly horizontal blasthole (40) or 4 meters length was primed with a detonator and a primer (41) at the toe. ANFO (43) (1.5 kilograms of average bulk density 0.9 g/cm$^3$) was loaded near the collar of the blasthole around a detonator (44) surrounded by a conically shaped shroud. The hole was then stemmed with stemming material (46). The shrouded detonator was fired to disperse the ANFO. FIG. 4(*b*) shows the blasthole lined with dispersed ANFO (47) at an average density of 0.24 g/cm$^3$. After a time delay of about 4 seconds, the primer was initiated. This in turn initiated the ANFO which was static and dispersed in the hole.

While the invention has been explained in relation to its preferred embodiments it is to be understood that various modifications thereof will become apparent to those skilled in the art upon reading the specification. Therefore, it is to be understood that the invention disclosed herein is intended to cover such modifications as fall within the scope of the appended claims.

The claims defining the invention are as follows:

1. A method of controlled blasting comprising providing an explosives composition in a blasthole, scattering randomly said explosives composition within the blasthole thereby increasing the spatial distribution of the explosives composition in the blasthole to form a randomly scattered explosives composition, and then detonating said explosives composition.

2. A method of controlled blasting according to claim 1 which further comprises locating a time delay initiating device in a blasthole prior to scattering randomly the explosives composition, and detonating said explosives composition by firing said time delay initiation device.

3. A method of controlled blasting according to claim 1 wherein the method comprises using a first retaining means to support the explosives composition in the blasthole, then disrupting or removing said first retaining means and allowing the explosives composition to be scattered randomly within the blasthole under gravity.

4. A method of controlled blasting according to claim 3 wherein a second retaining means is disposed between the first retaining means and a collar of the blasthole and stemming material is loaded onto the second retaining means.

5. A method of controlled blasting according to claim 1 wherein any explosives composition which is not scattered randomly is also detonated.

6. A method of controlled blasting according to claim 1 wherein the explosives composition comprises one or more chemical species selected from the group consisting of fuels, oxidizers, ANFO, ANFO based explosives, emulsion explosives, self-oxidizing compositions and mixtures thereof.

7. A method of controlled blasting according to claim 6 wherein the self-oxidizing composition is a molecular high explosive.

8. A method of controlled blasting according to claim 1 wherein the average bulk density of the explosives composition prior to scattering randomly is between 0.5 and 1.5 g/cm$^3$.

9. A method of controlled blasting according to claim 1 wherein the average bulk density of the randomly scattered explosives composition is between 0.001 and 1.2 g/cm$^3$.

10. A method of controlled blasting according to claim 9 wherein the average bulk density of the randomly scattered explosives composition at the time of detonation is between 0.001 and 1.2 g/cm$^3$.

11. A method of controlled blasting according to claim 1 wherein the explosives composition is scattered randomly by falling under gravity.

12. A method of controlled blasting according to claim 3 wherein the retaining means is an inflatable bag, a membrane or a blasthole plug.

13. A method of controlled blasting according to claim 3 wherein a small charge is used to remove or disrupt the retaining means.

14. A method of controlled blasting according to claim 13 wherein the detonation of the small charge causes or assists random scattering of the explosives composition.

15. A method of controlled blasting according to claim 1 wherein the explosives composition is detonated while all or part of the explosives composition is in the process of being scattering randomly.

16. A method of controlled blasting which comprises the steps of providing an explosives composition in a blasthole, dispersing by detonation of a charge said explosives composition within the blasthole to form a dispersed explosives composition, and then detonating said dispersed explosives composition.

17. A method of controlled blasting according to claim 16 which includes locating a time delay initiating device in a blasthole prior to dispersing the explosives composition, and detonating the dispersed explosives composition by firing the time delay initiation device.

18. A method of controlled blasting according to claim 16 wherein the explosives composition comprises one or more chemical species selected from the group consisting of fuels, oxidizers, ANFO, ANFO based explosives, emulsion explosives, self-oxidizing compositions and mixtures thereof.

19. A method of controlled blasting according to claim 14 wherein the self-oxidizing composition is a molecular high explosive.

20. A method of controlled blasting according to claim 16 wherein the explosives composition is detonated while all or part of the explosives composition is in the process of being dispersed.

21. A method of controlled basting according to claim 1, wherein the explosives composition is detonated after it has been scattered randomly.

22. A method of controlled blasting according to claim 1, wherein the explosives composition is scattered randomly by discharge of pressurised liquid and/or gas by a scattering explosive charge or by a charge.

* * * * *

UNITED STATES PATENT AND TRADEMARK OFFICE

CERTIFICATE OF CORRECTION

PATENT NO. : 6,453,818 B1
DATED : September 24, 2002
INVENTOR(S) : Geoffrey F. Brent It is certified that error appears in the above-identified patent and that said Letters Patent is hereby corrected as shown below:

Title page,
Item [30], Foreign Application Priority Data, delete "3071/96" and insert -- PO3071/96 --.

Signed and Sealed this

Twelfth Day of August, 2003

JAMES E. ROGAN
*Director of the United States Patent and Trademark Office*